US006559420B1

(12) United States Patent
Zarev

(10) Patent No.: US 6,559,420 B1
(45) Date of Patent: May 6, 2003

(54) MICRO-SWITCH HEATER WITH VARYING GAS SUB-CHANNEL CROSS-SECTION

(75) Inventor: Sasko Zarev, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/192,408

(22) Filed: Jul. 10, 2002

(51) Int. Cl.[7] ..... H05B 3/00

(52) U.S. Cl. ..... 219/209; 219/210; 200/182; 200/185; 200/193; 200/214; 200/233

(58) Field of Search ..... 219/209, 210, 219/201, 528, 543, 549; 300/328; 200/182, 185, 188, 193, 214, 221, 227, 228, 233, 234, 61.47, DIG. 43

(56) References Cited

U.S. PATENT DOCUMENTS 4,103,135 A * 7/1978 Gomez et al. ..... 200/185
4,419,650 A * 12/1983 John ..... 200/185
4,628,161 A * 12/1986 Thackrey ..... 200/61.47
4,652,710 A * 3/1987 Karnowsky et al. ..... 200/233
4,797,519 A * 1/1989 Elenbaas ..... 200/227
5,751,074 A * 5/1998 Prior et al. ..... 200/61.47
5,912,606 A * 6/1999 Nathanson et al. ..... 200/233
6,373,356 B1 * 4/2002 Gutierrez et al. ..... 200/233
6,396,012 B1 * 5/2002 Bloomfield ..... 200/233
6,501,354 B1 * 12/2002 Gutierrez et al. ..... 200/193
6,512,322 B1 * 1/2003 Fong et al. ..... 310/328

* cited by examiner

*Primary Examiner*—Teresa Walberg
*Assistant Examiner*—Fadi H. Dahbour

(57) ABSTRACT

An apparatus for separating a liquid in a liquid metal micro-switch. In representative embodiments, the apparatus comprises a heater and a sub-channel inside a structure. The heater is located inside a cavity of the structure onto which the liquid metal micro-switch is fabricated. The sub-channel inside the structure connects the cavity to a main channel. The sub-channel has a cross-sectional area. The value of the cross-sectional area at the boundary between the sub-channel and the main channel is less than the value of the cross-sectional area at the boundary between the sub-channel and the cavity. The gas permeates the cavity and the sub-channel and is capable of extending into the main channel.

5 Claims, 6 Drawing Sheets

MICRO-SWITCH HEATER WITH VARYING GAS SUB-CHANNEL CROSS-SECTION

FIELD OF THE INVENTION

The present invention relates generally to the field of microwave circuits, and more particularly to integrated thick film RF and microwave microcircuit modules, and even more particularly to micro-switches and heaters within such modules.

BACKGROUND OF THE INVENTION

Electronic circuits of all construction types typically have need of switches and relays. The typical compact, mechanical contact type relay is a lead relay. A lead relay comprises a lead switch, in which two leads composed of a magnetic alloy are contained, along with an inert gas, inside a miniature glass vessel. A coil for an electromagnetic drive is wound around the lead switch, and the two leads are installed within the glass vessel as either contacting or non-contacting.

Lead relays include dry lead relays and wet lead relays. Usually with a dry lead relay, the ends (contacts) of the leads are composed of silver, tungsten, rhodium, or an alloy containing any of these, and the surfaces of the contacts are plated with rhodium, gold, or the like. The contact resistance is high at the contacts of a dry lead relay, and there is also considerable wear at the contacts. Since reliability is diminished if the contact resistance is high at the contacts or if there is considerable wear at the contacts, there have been various attempts to treat the surface of these contacts.

Reliability of the contacts may be enhanced by the use of mercury with a wet lead relay. Specifically, by covering the contact surfaces of the leads with mercury, the contact resistance at the contacts is decreased and the wear of the contacts is reduced, which results in improved reliability. In addition, because the switching action of the leads is accompanied by mechanical fatigue due to flexing, the leads may begin to malfunction after some years of use.

A newer type of switching mechanism is structured such that a plurality of electrodes are exposed at specific locations along the inner walls of a slender sealed channel that is electrically insulating. This channel is filled with a small volume of an electrically conductive liquid to form a short liquid column. When two electrodes are to be electrically closed, the liquid column is moved to a location where it is simultaneously in contact with both electrodes. When the two electrodes are to be opened, the liquid column is moved to a location where it is not in contact with both electrodes at the same time.

To move the liquid column, Japanese Laid-Open Patent Application SHO 47-21645 discloses creating a pressure differential across the liquid column is created. The pressure differential is created by varying the volume of a gas compartment located on either side of the liquid column, such as with a diaphragm.

In another development, Japanese Patent Publication SHO 36-18575 and Japanese Laid-Open Patent Application HEI 9-161640 disclose creating a pressure differential across the liquid column by providing the gas compartment with a heater. The heater heats the gas in the gas compartment located on one side of the liquid column. The technology disclosed in Japanese Laid-Open Patent Application 9-161640 (relating to a microrelay element) can also be applied to an integrated circuit. Other aspects are discussed by J. Simon, et al. in the article "A Liquid-Filled Microrelay with a Moving Mercury Drop" published in the Journal of Microelectromechanical Systems, Vol.6, No. 3, Sep. 1997. Disclosures are also made by You Kondoh et al. in U.S. Pat. No. 6,323,447 entitled "Electrical Contact Breaker Switch, Integrated Electrical Contact Breaker Switch, and Electrical Contact Switching Method".

Speed of operation, power requirements for switching, and switching reliability are all important considerations for such switches. Repeated switching cycles have been found to result in the occurrence of short circuits. A possible cause for these short circuits is the increased wetting of the material surface by the mercury caused by the formation of microcracks in the material due to the repeated exposure of the material to the high temperatures experienced during the switching process. Thus, it would be advantageous to provide techniques which would reduce the amount of heat dissipated in the walls of the material surrounding the liquid metal, while increasing the speed of switching.

SUMMARY OF THE INVENTION

An apparatus for separating a liquid in a liquid metal micro-switch is disclosed in representative embodiments. The apparatus comprises a heater and a sub-channel inside a structure. The heater is located inside a cavity of the structure onto which the liquid metal micro-switch is fabricated. The sub-channel inside the structure connects the cavity to a main channel. The sub-channel has a cross-sectional area. The value of the cross-sectional area at the boundary between the sub-channel and the main channel is less than the value of the cross-sectional area at the boundary between the sub-channel and the cavity. The gas permeates the cavity and the sub-channel and is capable of extending into the main channel.

Other aspects and advantages of the present invention will become apparent from the following detailed description, taken in conjunction with the accompanying drawings, illustrating by way of example the principles of the invention.

BRIEF DESCRIPTION OF THE DRAWINGS

The accompanying drawings provide visual representations which will be used to more fully describe the invention and can be used by those skilled in the art to better understand it and its inherent advantages. In these drawings, like reference numerals identify corresponding elements.

DETAILED DESCRIPTION OF THE PREFERRED EMBODIMENTS

Figure 1A:
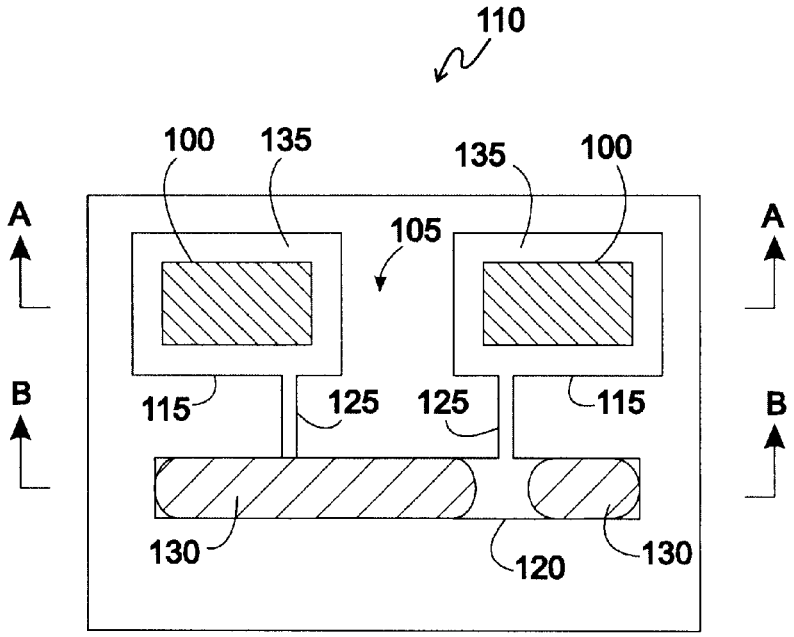
FIG. 1A is a drawing of a top view of a heater actuated, liquid metal micro-switch in a microcircuit.

As shown in the drawings for purposes of illustration, the present patent document relates to techniques for providing gas flow in heater actuated, liquid metal micro-switches in microcircuits. The resultant configurations provide gas flow to move the liquid metal in a channel of the micro-switch with less anticipated heat dissipation in that channel and associated resultant reduction in microcracks and channel surface wetting, thereby increasing switch life.

In the following detailed description and in the several figures of the drawings, like elements are identified with like reference numerals.

FIG. 1A is a drawing of a top view of a heater 100 actuated, liquid metal micro-switch 105 in a microcircuit 110. The microcircuit 110 of FIG. 1A is more generally referred to as electronic circuit 110. The circuit 110 is typically fabricated in a structure 111 using thin film deposition techniques and/or thick film screening techniques which could comprise either single-layer or multi-layer ceramic circuit substrates. The heaters 100 could be, for example, monolithic heaters 100 fabricated using conventional silicon integrated circuit methods. The structure 111, while not specifically pointed out in the drawings, will be understood by one of ordinary skill in the art to comprise the substrate and any encapsulating items, as for example a lid 145. While the only component shown in the electronic circuit 110 in FIG. 1A is the liquid metal micro-switch 105, it will be understood by one of ordinary skill in the art that other components can be fabricated as a part of the circuit 110. In FIG. 1A, the liquid metal micro-switch 105 comprises two heaters 100 located in separate cavities 115. The cavities 115 are each connected to a main channel 120 via separate sub-channels 125. The main channel 120 is partially filled with a liquid metal 130 which is typically mercury 130. The cavities 115 , the sub-channels 125, and that part of the main channel 120 not filled with the liquid metal 130 is filled with a gas 135, which could be, for example, an inert gas such as nitrogen 135. In the switch state shown in FIG. 1A, the mercury 130 is divided into two pockets of unequal volumes. Note that the left hand volume in FIG. 1A is greater than that of the right hand volume. The functioning of the liquid metal micro-switch 105 will be explained in the following paragraphs.

Figure 1B:
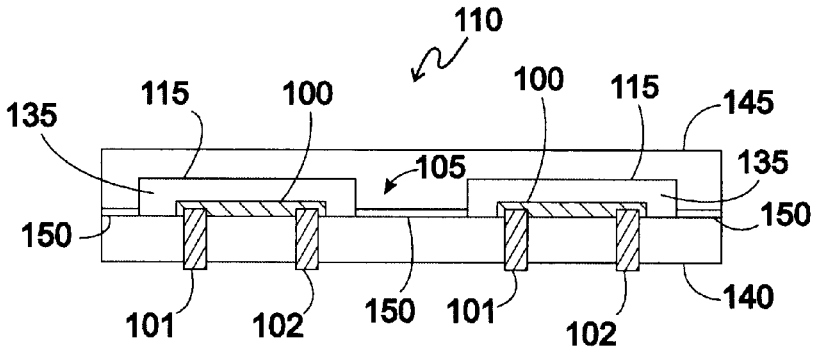
FIG. 1B is a drawing of a side view of the heater actuated, liquid metal micro-switch at section A—A of FIG. 1A.

FIG. 1B is a drawing of a side view of the heater 100 actuated, liquid metal micro-switch 105 at section A—A of FIG. 1A. Section A—A is taken along a plane passing through the heaters 100. In FIG. 1B, the heaters 100 are mounted to the substrate 140 upon which the electronic circuit 110 is fabricated. A lid 145, which is sealed at mating surfaces 150, covers the liquid metal micro-switch 105. Electrical contact is made to the heaters 100 via first and second heater contacts 101,102 to each of the heaters 100. As indicated above, an electric current passed through the left side heater 100 will cause the gas 135 in the left side cavity 115 to expand. This expansion will continue until a part of the gas enters the main channel 120 via the left side sub-channel 125.

Figure 1C:
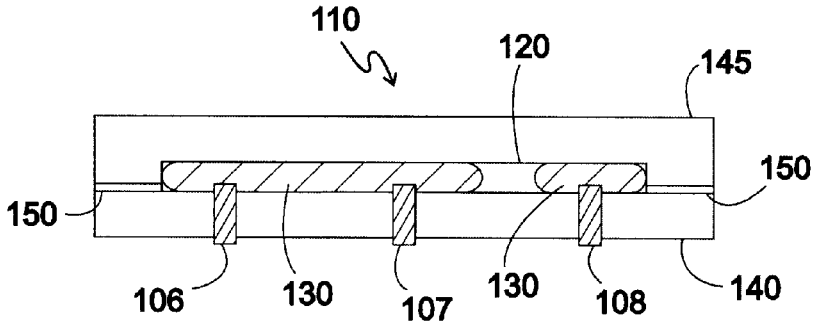
FIG. 1C is a drawing of a side view of the heater actuated, liquid metal micro-switch at section B—B of FIG. 1A.

FIG. 1C is a drawing of a side view of the heater 100 actuated, liquid metal micro-switch 105 at section B—B of FIG. 1A. Section B—B is taken along a plane passing through the main channel 120. The liquid metal 130 on the left side of FIG. 1C being larger in volume than that on the right side electrically shorts together a first and second micro-switch contacts 106,107 of the liquid metal micro-switch 105, while the volume of the liquid metal 130 on the right side of FIG. 1C being the smaller, a third micro-switch contact 108 also on the right side of FIG. 1C forms an open-circuit.

Figure 2A:
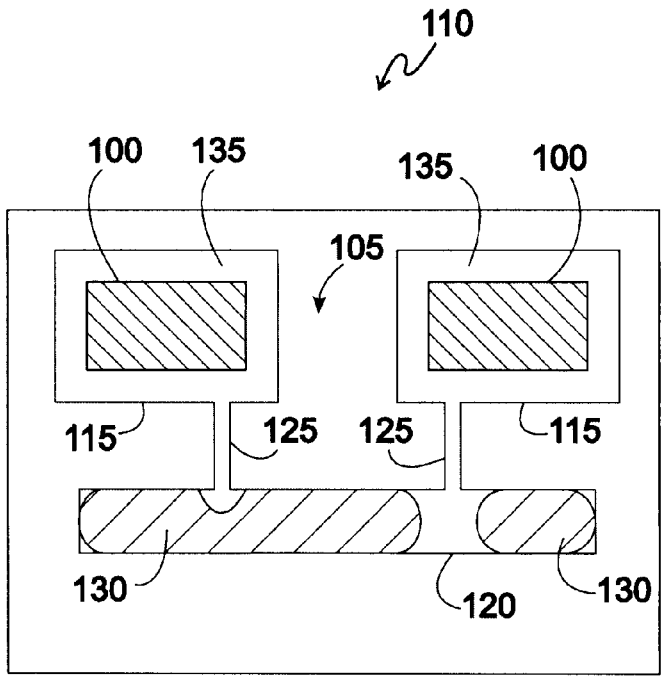
FIG. 2A is another drawing of the top view of the heater actuated, liquid metal micro-switch in the microcircuit.

FIG. 2A is another drawing of the top view of the heater 100 actuated, liquid metal micro-switch 105 in the microcircuit 110. FIG. 2A shows the condition of the liquid metal micro-switch 105 shortly after the left side heater 100 has been activated. In this condition, the gas 135 in the left side cavity 115 has been heated just enough to begin forcing, at the interface between the main channel 120 and the left side sub-channel 125, a part of the liquid metal 130 on the left side of the main channel 120 toward the right side of the main channel 120.

Figure 2B:
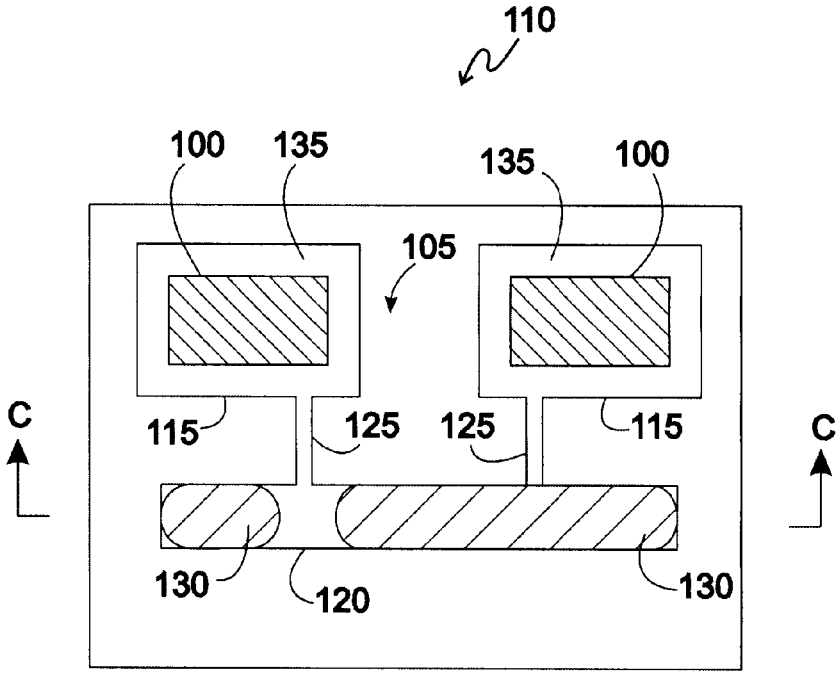
FIG. 2B is still another drawing of the top view of the heater actuated, liquid metal micro-switch in the microcircuit.

FIG. 2B is still another drawing of the top view of the heater 100 actuated, liquid metal micro-switch 105 in the microcircuit 110. FIG. 2B shows the condition of the liquid metal micro-switch 105 after the left side heater 100 has been more fully activated. In this condition, the gas 135 in the left side cavity 115 has been heated enough to force a part of the liquid metal 130 originally on the left side of the main channel 120 into the right side of the main channel 120.

Figure 2C:
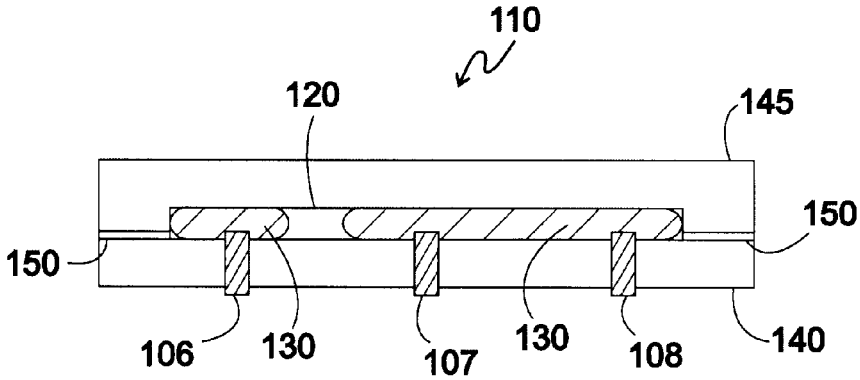
FIG. 2C is a drawing of a side view of the heater actuated, liquid metal micro-switch at section C—C of FIG. 2B.

FIG. 2C is a drawing of a side view of the heater 100 actuated, liquid metal micro-switch 105 at section C—C of FIG. 2B. Section C—C is taken along a plane passing through the main channel 120. The liquid metal 130 on the right side of FIG. 1C now electrically shorts the second and third micro-switch contacts 107,108 of the liquid metal micro-switch 105 while the first micro-switch contact 106 on the left side of FIG. 2C now forms an open-circuit.

Figure 3:
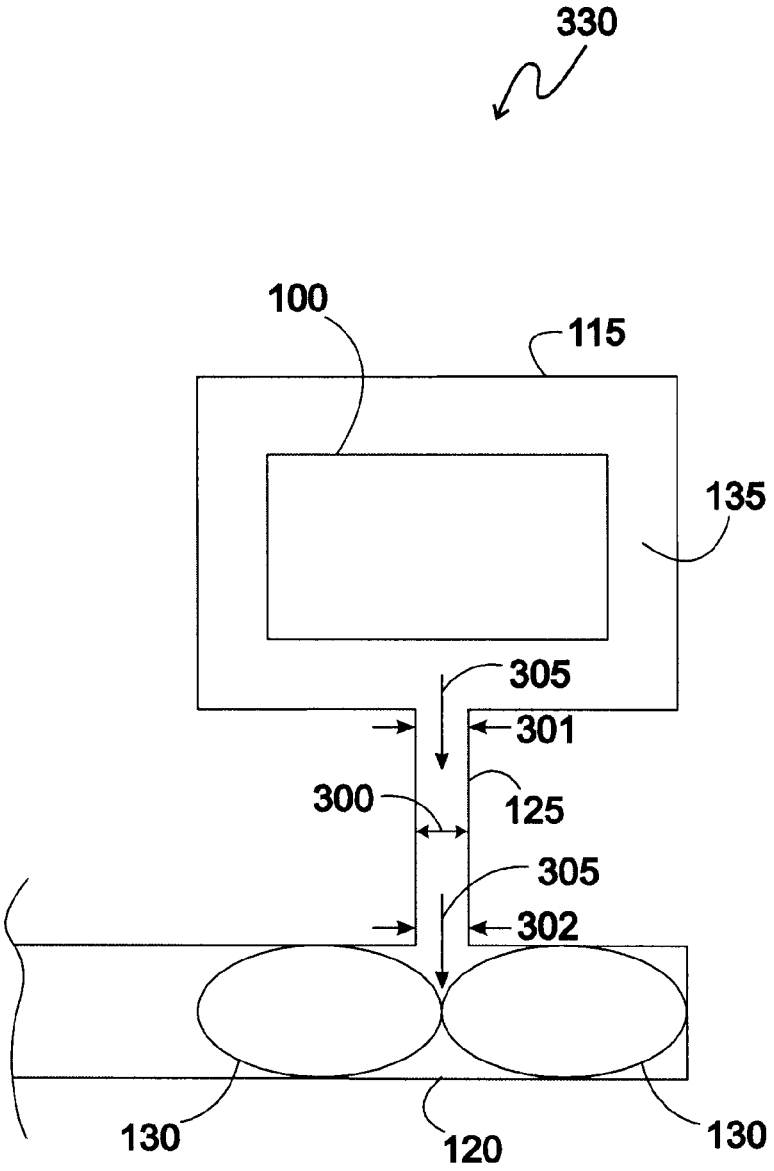
FIG. 3 is a drawing of the top view of part of a heater actuated, liquid metal micro-switch.

FIG. 3 is a drawing of the top view of part of a heater 100 actuated, liquid metal micro-switch 105. An apparatus 330 for separating a gas 135 comprises a heater 100 and a sub-channel 125. In FIG. 3, the heater 100, which could be, for example, a monolithic, integrated circuit 100, is located in the cavity 115. The cavity 115 is connected to the main channel 120 via sub-channel 125. The main channel 120 is partially filled with a liquid metal 130 which is typically mercury 130. The sub-channel 125 has a cross-sectional area 300 indicated in FIG. 3 by a double headed arrow within the sub-channel 125. The cross-sectional area 300 at the boundary between the sub-channel 125 and the cavity 115 has a first value 301, and the cross-sectional area 300 at the boundary between the sub-channel 125 and the main channel 120 has a second value 302. In FIG. 3, the first value 301 and the second value 302 are equal. As such, when the heater reaches a pseudo-equilibrium state, the velocity of the gas exiting the sub-channel 125 at the boundary of the sub-channel 125 and the main channel 120 is equal to the velocity of the gas 135 entering the sub-channel 125 at the boundary of the sub-channel 125 and the cavity 115. The direction of flow 305 of gas 135 is shown by the direction of the arrows in FIG. 3.

Figure 4:
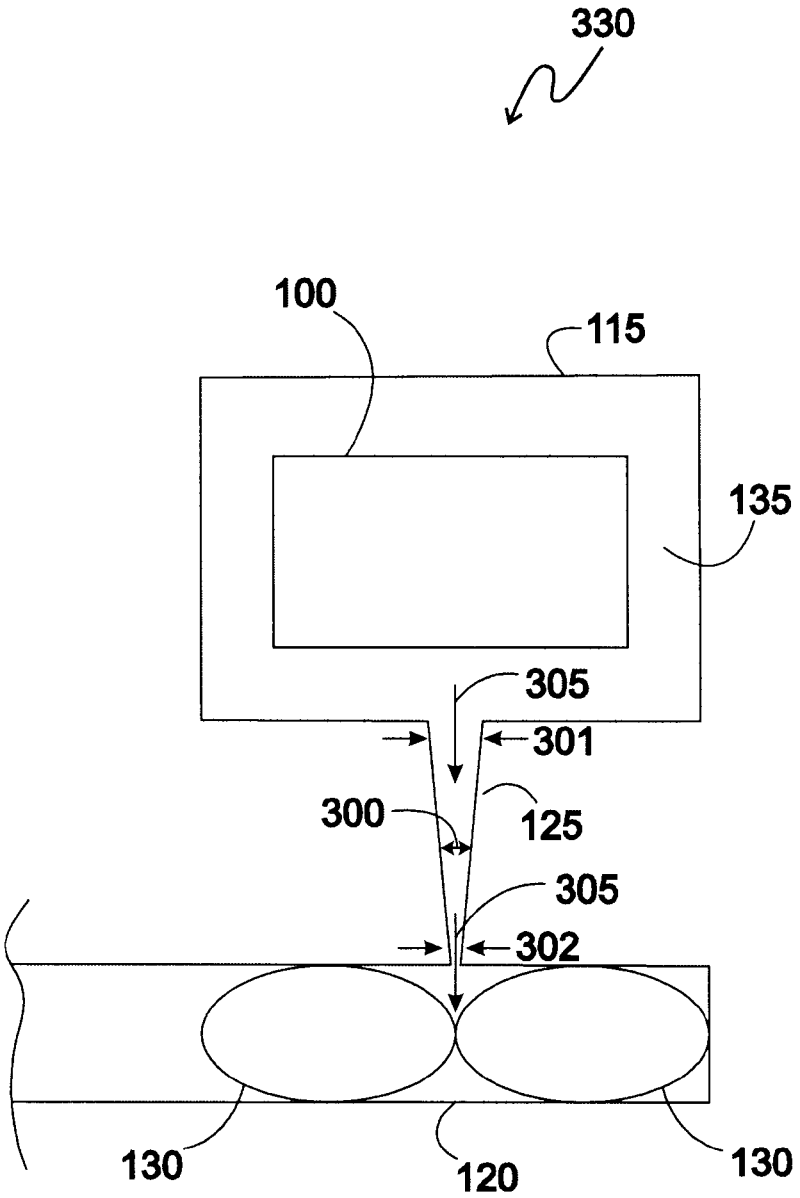
FIG. 4 is a drawing of the top view of part of another heater actuated, liquid metal micro-switch as described in various representative embodiments consistent with the teachings of the invention.

FIG. 4 is a drawing of the top view of part of another heater 100 actuated, liquid metal micro-switch 105 as described in various representative embodiments consistent with the teachings of the invention. An apparatus 330 for separating a gas 135 comprises a heater 100, which could be, for example, a monolithic, integrated circuit 100, and a sub-channel 125. In FIG. 4, the heater 100 is located in the cavity 115. The cavity 115 is connected to the main channel 120 via sub-channel 125. The main channel 120 is partially filled with a liquid metal 130 which is typically mercury 130. The sub-channel 125 has a cross-sectional area 300 indicated in FIG. 4 by a double headed arrow within the sub-channel 125. The cross-sectional area 300 at the boundary between the sub-channel 125 and the cavity 115 again has a first value 301, and the cross-sectional area 300 at the boundary between the sub-channel 125 and the main channel 120 has a second value 302. In FIG. 4, the first value 301 is greater than the second value 302. Moreover, in FIG. 4 the cross-sectional area 300 decreases linearly in value from the first value 301 at the boundary between the sub-channel 125 and the cavity 115 to the second value 302 at the boundary between the sub-channel 125 and the main channel 120. As such, when the heater reaches a pseudo-equilibrium state, the velocity of the gas exiting the sub-channel 125 at the boundary of the sub-channel 125 and the main channel 120 is greater than the velocity of the gas 135 entering the sub-channel 125 at the boundary of the sub-channel 125 and the cavity 115. The direction of flow 305 of gas 135 is shown by the direction of the arrows in FIG. 4.

Figure 5:
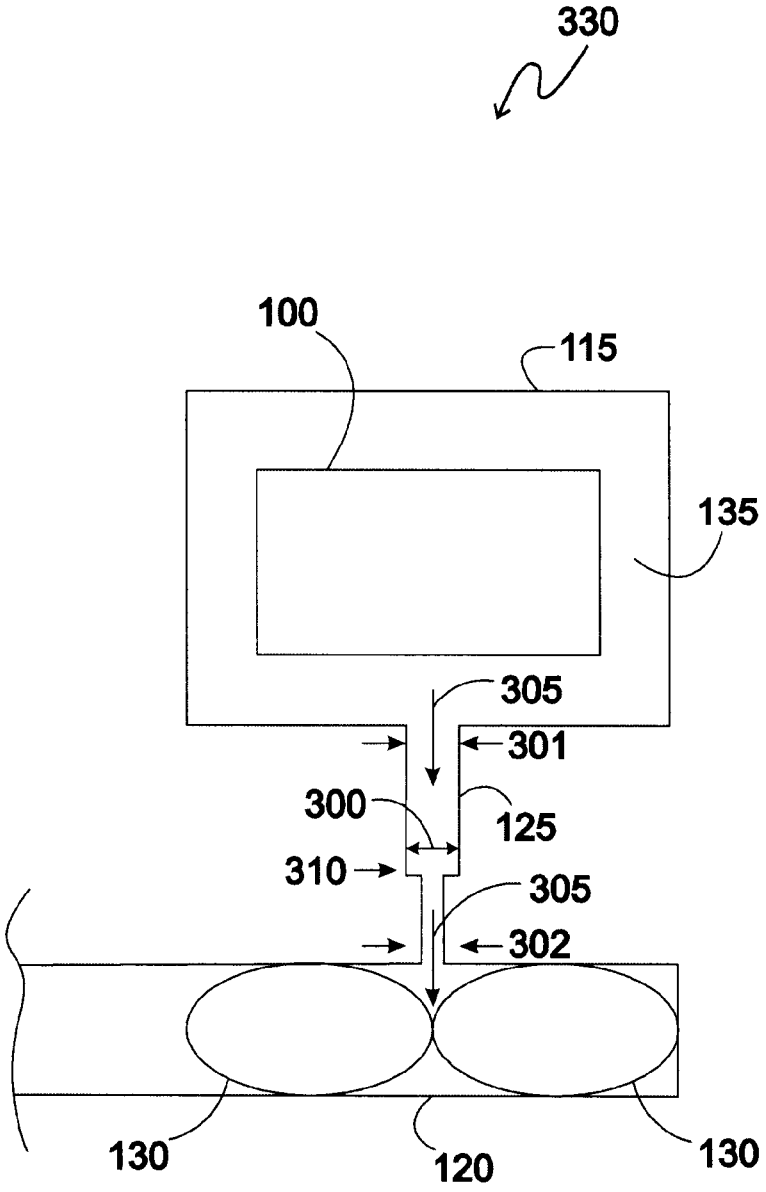
FIG. 5 is a drawing of the top view of part of still another heater actuated, liquid metal micro-switch as described in various representative embodiments consistent with the teachings of the invention.

FIG. 5 is a drawing of the top view of part of still another heater 100 actuated, liquid metal micro-switch 105 as described in various representative embodiments consistent with the teachings of the invention. An apparatus 330 for separating a gas 135 comprises a heater 100, which could be, for example, a monolithic, integrated circuit 100, and a sub-channel 125. In FIG. 5, the heater 100 is located in the cavity 115. The cavity 115 is connected to the main channel 120 via sub-channel 125. The main channel 120 is partially filled with a liquid metal 130 which is typically mercury 130. The sub-channel 125 has a cross-sectional area 300 indicated in FIG. 5 by a double headed arrow within the sub-channel 125. The cross-sectional area 300 at the boundary between the sub-channel 125 and the cavity 115 has a first value 301, and the cross-sectional area 300 at the boundary between the sub-channel 125 and the main channel 120 has a second value 302. In FIG. 5, the first value 301 is greater than the second value 302. Moreover, in FIG. 5 a position 310 is located between the boundary between the sub-channel 125 and the cavity 115 and the boundary between the sub-channel 125 and the main channel 120. The value of the cross-sectional area 300 of the sub-channel 125 is maintained at the first value 301 from the boundary between the sub-channel 125 and the cavity 115 and the position 310. The value of the cross-sectional area 300 of the sub-channel 125 is maintained at the second value 302 from the position 310 and the boundary between the sub-channel 125 and the main channel 120. As such, when the heater reaches a pseudo-equilibrium state, the velocity of the gas exiting the sub-channel 125 at the boundary of the sub-channel 125 and the main channel 120 is greater than the velocity of the gas 135 entering the sub-channel 125 at the boundary of the sub-channel 125 and the cavity 115. The direction of flow 305 of gas 135 is shown by the direction of the arrows in FIG. 5. The geometry of the sub-channel 125 of FIG. 5 should be easier and less expensive to fabricate than that of FIG. 4.

A primary advantage of the embodiments as described herein over prior cross-sectional area 300 geometries for sub-channels 125 for transferring gas 135 from the cavities 115 to the main channels 120 in microcircuits 110 is greater velocity of the gas 135 upon exiting the sub-channel 125 and entering the main channel 120. This greater velocity results in a more rapid separation of the liquid metal 130 and thus less heat build-up in the main channel 120 with associated less stress on the walls of the main channel 120. The useful life of the liquid metal micro-switch 105 will then be increased as the rate of increase of wetting of the surface of the main channel 120 is less than it would be for the slower velocities of FIG. 3.

While the present invention has been described in detail in relation to preferred embodiments thereof, the described embodiments have been presented by way of example and not by way of limitation. It will be understood by those skilled in the art that various changes may be made in the form and details of the described embodiments resulting in equivalent embodiments that remain within the scope of the appended claims.

What is claimed is:

1. An apparatus for separating a liquid in a liquid metal micro-switch which comprises:

a heater, wherein the heater is located inside a cavity of a structure onto which the liquid metal micro-switch is fabricated; and a sub-channel inside the structure connecting the cavity to a main channel, wherein the sub-channel has a cross-sectional area, wherein the value of the cross-sectional area at the boundary between the sub-channel and the main channel is less than the value of the cross-sectional area at the boundary between the sub-channel and the cavity, and wherein a gas permeates the cavity and the sub-channel, and wherein the gas is capable of extending into the main channel.

2. The apparatus as recited in claim 1, wherein the heater is a monolithic heater.

3. The apparatus as recited in claim 1, wherein the apparatus is part of a thick film microcircuit.

4. The apparatus as recited in claim 1, wherein the cross-sectional area at the boundary between the sub-channel and the cavity has a first value, wherein the cross-sectional area at the boundary between the sub-channel and the main channel has a second value, wherein the cross-sectional area of the sub-channel is maintained at the first value between the boundary between the sub-channel and the cavity and a preselected position between the boundary between the sub-channel and the cavity and the boundary between the sub-channel and the main channel, and wherein the cross-sectional area of the sub-channel is maintained at the second value from the preselected position and the boundary between the sub-channel and the main channel.

5. The apparatus as recited in claim 1, wherein the cross-sectional area decreases linearly from its value at the boundary between the sub-channel and the cavity and its value at the boundary between the sub-channel and the main channel.

* * * * *